United States Patent [19]

Halen

[11] Patent Number: 4,596,020

[45] Date of Patent: Jun. 17, 1986

[54] METAL MELTING AND MELT HEAT RETAINING FURNACE

[75] Inventor: Lars Halen, Västerås, Sweden

[73] Assignee: Asea AB, Västerås, Sweden

[21] Appl. No.: 541,354

[22] Filed: Oct. 12, 1983

[30] Foreign Application Priority Data

Oct. 18, 1982 [SE] Sweden ..... 8205898
Jun. 15, 1983 [SE] Sweden ..... 8303419

[51] Int. Cl.[4] ..... H05B 6/34

[52] U.S. Cl. ..... 373/161; 373/159; 373/160

[58] Field of Search ..... 373/138, 144, 159, 160, 373/161, 163, 162; 219/405, 411

[56] References Cited

U.S. PATENT DOCUMENTS

| | | | |
|---|---|---|---|
| 1,647,787 | 11/1927 | Zubiria | 373/159 |
| 2,499,540 | 3/1950 | Tama | 373/163 |
| 2,540,744 | 2/1951 | Lillienberg | 373/161 |
| 2,641,621 | 4/1957 | Greene | 373/159 |
| 2,648,715 | 8/1953 | Lillienberg | 373/161 |
| 2,674,639 | 4/1952 | Stevenson | 373/161 |
| 2,805,271 | 9/1957 | Lang | 373/159 |
| 2,892,005 | 6/1959 | Lang et al. | 373/159 |

FOREIGN PATENT DOCUMENTS

| | | | |
|---|---|---|---|
| 0104535 | 3/1942 | Sweden | 373/159 |
| 0571304 | 8/1945 | United Kingdom | 373/161 |

*Primary Examiner*—A. D. Pellinen
*Assistant Examiner*—Gregory D. Thompson
*Attorney, Agent, or Firm*—Kenyon & Kenyon

[57] ABSTRACT

A furnace for melting and melt-heat retaining of metals has two horizontal interspaced furnace vessels which form a melt chamber and each having a side wall facing the side wall of the other furnace vessel, each side wall having an opening horizontally aligned with the opening of the side wall of the other furnace vessel. A single inductor is positioned between these side walls and is formed by an integral block of ceramic having opposite ends abutting the outside of the side walls. The block has a transverse through-hole and two longitudinal through-holes straddling the transverse through-hole and open to the two furnace vessels so that they intercommunicate. The inductor has a core with an energizing coil and having a leg extending through the transverse hole. When the energizing coil is powered a melt in the two longitudinal through-holes is heated by an induced circuit which extends into and through melts in the two furnace vessels. When required, the inductor can be shut down and the melt heat-retaining is effected because the furnace vessels have roofs mounting electric resistance heaters of low power which can be operated at that time.

2 Claims, 10 Drawing Figures

METAL MELTING AND MELT HEAT RETAINING FURNACE

BACKGROUND OF THE INVENTION

Channel-type induction furnaces are used for the melting and melt heat-retaining of metals, such as aluminum and aluminum alloys, an example, being shown by the Fredrikson et al Pat. No. 3,618,917.

Each furnace vessel requires its own channel-type inductor, used for both melting and heat retaining when output of melt is interrupted. The inductor is conventionally positioned in the furnace bottom in the hottest environment around the furnace, and during such periods it must be continuously force-cooled, its channel containing a continuous flow of melt at such times.

SUMMARY OF THE INVENTION

Briefly summarized, the furnace of the present invention comprises two horizontally interspaced furnace vessels each forming a metal-containing chamber and each having a side wall facing the side wall of the other furnace vessel and an opening in its side wall opening from its chamber and horizontally aligned with the opening of the side wall of the other furnace vessel. A single inductor is positioned between these side walls and comprises an integral block of ceramic having opposite ends abutting the outsides of the two side walls, a transverse through-hole and two longitudinal through-holes straddling the transverse through-hole and having ends open to the chambers of the two furnace vessels so these chambers are interconnected. The inductor has a core provided with an energizing coil and having a leg extending through the transverse hole straddled by the two longitudinal through-holes. The inductor between the two furnace vessels can be shut down during periods when melt heat retaining only is required, because the two furnace vessel roofs mount on their undersides heating means of low energy requirement, as compared to that required for the inductor during melting, but sufficient for melt heat retaining for an adequate time. During melting the single inductor provides melting for both furnace vessels.

The inductor is removable for replacement when required, its ends seperably abutting the interfacing side walls of the two furnace vessels, one of the furnace vessels being horizontally moveable towards and from the other and releasable means being provided for forcing and holding the two furnace vessels together with the inductor in effect sandwiched between the two furnace vessels. Seperation of the furnace vessels permits removal of the inductor.

Specific examples of the new furnace are described below with the aid of the accompanying drawings in which:

DETAILED DESCRIPTION OF THE EMBODIMENT

Figures 1, 2:
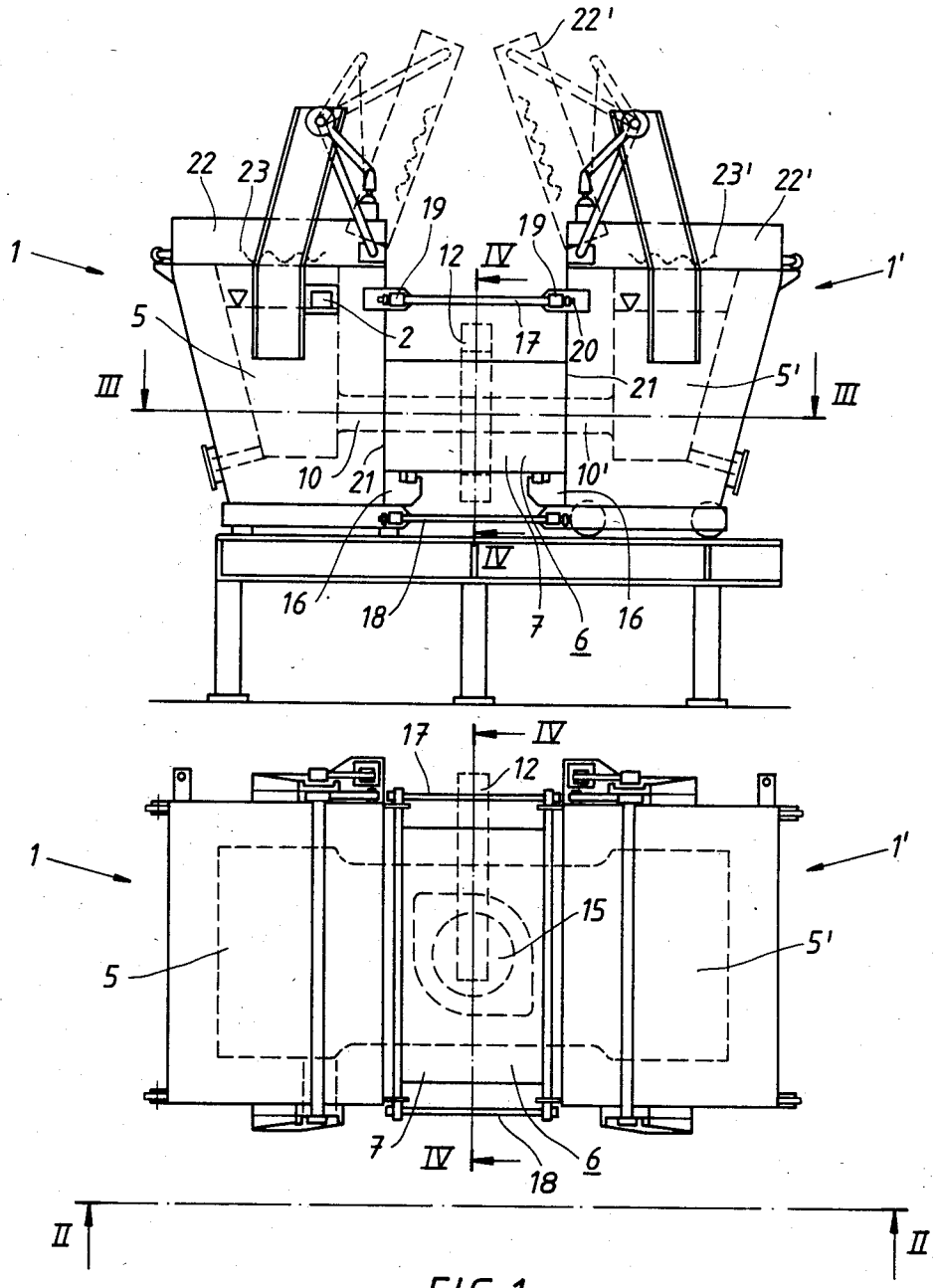
FIG. 1 is a top plan view of one example of the new furnace.
FIG. 2 is a side elevation view as indicated by the Line II—II in FIG. 1.
Figure 3:
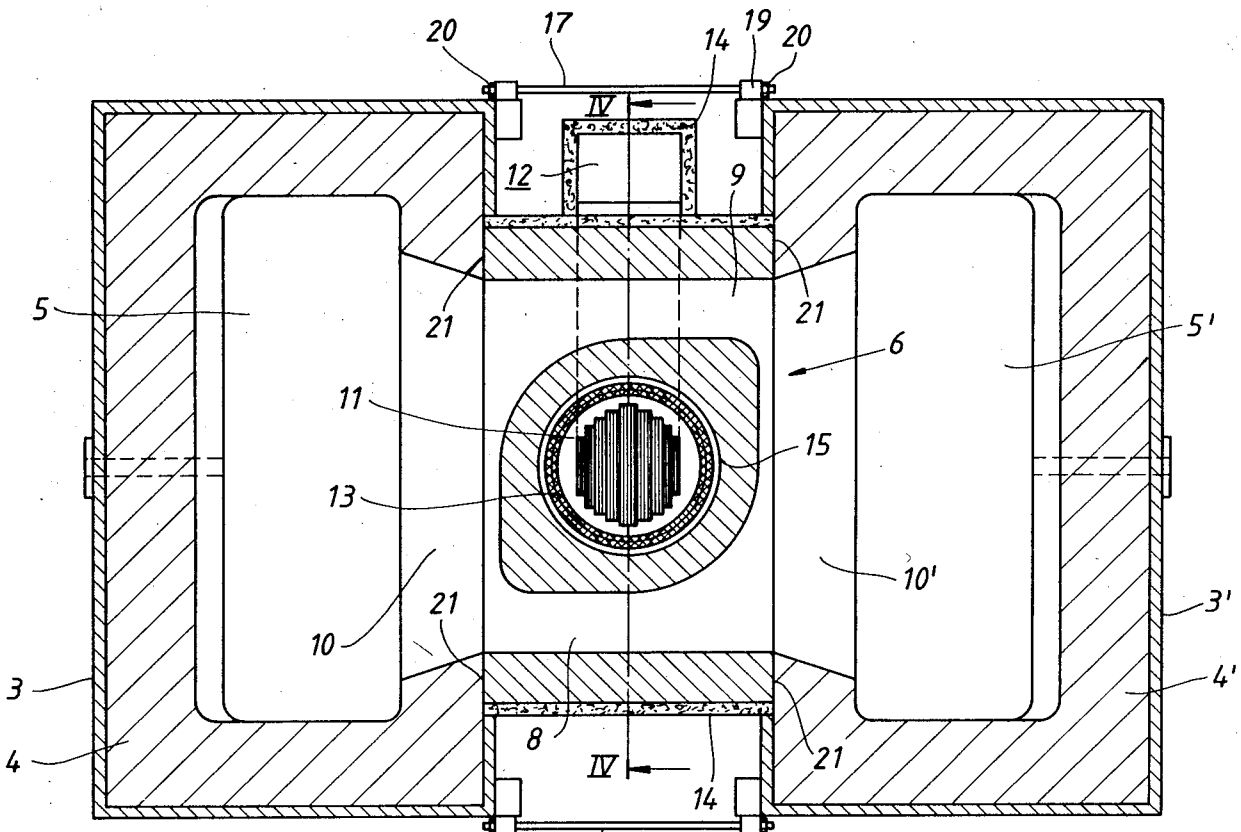
FIG. 3 is a horizontal cross section taken on the Line III—III in FIG. 2.

In the first example shown by FIGS. 1 through 4, the two horizontally interspaced vessels 1 and 1' are identical except that the vessel 1 has near its top a tapping hole 2 for the melt, this being unnecessary for the furnace vessel 1'. Each furnace vessel has a sheet steel shell, 3 and 3' respectively, and a refractory ceramic lining 4 and 4' respectively, the linings enclosing chambers 5 and 5' respectively.

Figure 4:
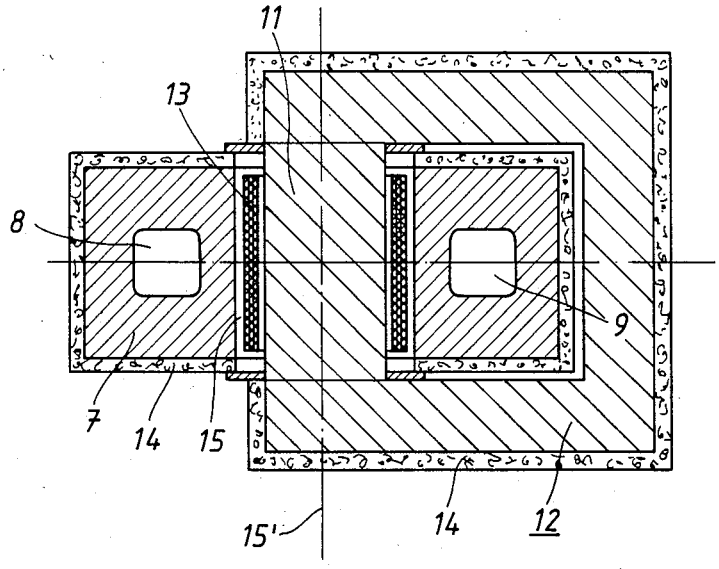
FIG. 4 is a vertical cross section of the inductor only as taken on the Line IV—IV in FIG. 3.

The furnace vessels have interfacing vertical side walls and the furnace inductor 6 is positioned between these side walls and comprises a single, integral, block 7 made of a ceramic having adequate refractory properties and, in addition, high mechanical strength, particularly in compression. The block 7 is substantially a parallelepipedic block having two horizontal longitudinal through-holes 8 and 9. The two interfacing vertical side walls, of the furnace vessels has an opening 10 and 10' respectively, these openings being horizontally aligned with each other. The inductor block 7 has its ends seperably abutting the outsides of these vertical side walls, its two through-holes 8 and 9 opening through the openings 10 and 10' and placing the two chambers 5 and 5' in intercommunication with each other. There is in effect, a hydraulic interconnection between the two chambers. The inductor block 7 also has a vertical cylindrical through-hole 15 which is straddled by the two horizontal holes 8 and 9, the hole 15 therefore extending transversely with respect to the two horizontal holes. A transformer or inductor core 12 has a leg 11 extending vertically through the vertical hole 15 of the block, and this leg is surrounded by the primary winding or coil 13. The balance of the core 12 extends around the outside of one side of the block 7, as shown by FIG. 4, and it as well as all outside surfaces of the inductor block 7 are encased by refractory thermal insulation 14. This retards the escape of heat from the inductor block and inductor core. During melt heat retaining periods, when the inductor is unpowered or shut down, this thermal insulation assists in maintaining molten the melt in the inductor's channels. As described below the furnace is provided with other relatively low-powered heating means for retaining the melt molten in the two furnace vessels during such periods.

The weight of the inductor 6 is supported by brackets 16 extending from the outsides of the two furnace vessels so that the inductors weight need not be carried solely by frictional engagement between the inductor's ends and the outsides of the two vertical walls of the furnace vessels. The furnace vessel 1' can be carried on a horizontally running carriage, so that it is moveable towards and away from the other furnace vessel. Means are provided for releasably forcing and holding the two furnace vessels together so that the inductor block can be tightly sandwiched between the furnace vessels, this means being illustrated as comprising upper and lower tie bolts or tension rods 17 and 18 having their ends inserted in lugs 19 attached to the outsides of the furnace vessels 1 and 1' respectively, and provided with nuts 20. When the inductor is in position, supported by the brackets 16, the nuts 20 are screwed-up so the two furnace vessels are pulled together with the ends of the inductor block forceably pressed against the vertical side walls of the two furnace vessels with adequate force to form a seal preventing escape of melt from the inductor block's horizontal through-holes 8 and 9.

The furnace vessel 1 is provided with a normally closed drain hole in its bottom, which can be opened to empty the entire furnace free from a melt when the furnace is to be put out of service for removal of the inductor 7. For this the nuts 20 are loosened so that the furnace vessel 1' can be run away from the other furnace vessel enough to free the inductor 6. Then the inductor can be lifted away by a crane for possible replacement by a new or reconditioned corresponding inductor. When loosened the inductor will not fall because of its support by the brackets 16.

During normal operations of the new furnace the furnace vessel 1' is charged with solid metal and tapped from the furnace vessel 1 via its tap hole 2. An interruption in the charging or tapping for any reason requires holding of the melt in the furnace vessels and the inductor channels 8 and 9. The furnace must then function only as a heat retaining furnace. In prior art furnaces this has been done by using the channel-type inductor but the inductor, normally connected to the bottom of the furnace in prior art furnaces, is subjected to excessive heating, the hottest part of the melt being in the inductor's channels. This has required the inductor to be force-cooled as by water cooling or the like.

Contrasting with the above with this new furnace the inductor is completely shut-down, or unpowered, when heat retaining only is required.

For heat retaining each one of the furnace vessels 1 and 1' is provided with a removable roof 22 and 22' respectively made of sheet metal with a lining of heat-insulating refractory. The underside or bottoms of the roofs have electric resistors 23 and 23', respectively, connected to them and which can optionally be electrically powered. They are powered during any heat retaining period.

Each of the two electric resistors may have a maximum power substantially less than that of the inductor 6, preferably less than 5% thereof, and a 15% value can be considered as a maximum. The heat output provided by the two resistors 23 and 23' should be adequate, with the inductor 6 unpowered, to keep the melt in the two furnace vessels in a molten state for at least several hours and preferably for several days, during which time the inductor is idle and free from excessive heating. The inductor's two horizontal through-holes 8 and 9 are straight and interconnect the two melts in the furnace vessels, so the melt in these channels is not apt to solidify. The heat is largely retained by the thermal insulation 14 surrounding the inductor.

Excepting for a complete shut down of the furnace, the melt level in the furnace should always be high enough so that the inductor's two straight through-holes 8 and 9 are kept filled with melt, the secondary circuit then being formed in the melt as a loop extending through the two straight channels and looping at their ends in the melts in the two furnace vessels. This formation of the secondary circuit is indicated by the broken line SC in FIG. 3. Both covers 22 and 22' can be swung up and out of the way by any suitable mechanism, the mechanisms illustrated by FIGS. 1 and 2 therefore requiring no specific description.

Charging of the new furnace with solid metal is normally done by removing the roof of the furnace vessel 1' and charging directly in its chamber 5'. When the melt reaches up to the tapping hole opening 2 in the vessel, additional charging results in molten metal running out of the tapping hole 2. The tapped molten metal may be used directly or can be fed to a special heat retaining furnace designed only to retain the heat of the melt, and from which the melt is drawn as needed. This special furnace is not shown.

Figure 5:
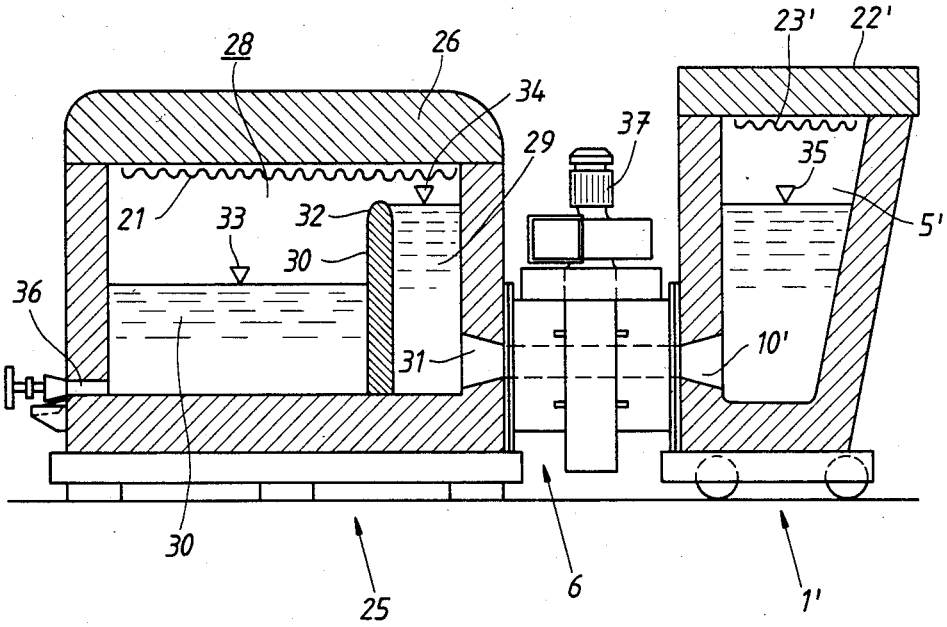
FIG. 5 is a vertical section of a second example of the new furnace, the inductor being shown in side elevation.

When such a special heat retaining furnace is not available for storage of the melt, the new furnace may be designed as shown by FIG. 5. In this case a furnace vessel 25 is used, having a substantially larger capacity than the furnace vessel 1 of FIGS. 1 and 2. This furnace vessel 25 also has a heat-insulating cover 26 on the bottom side of which an electric heat resistant element 21 is connected, for use as described before. Because of the larger size of this furnace vessel 25 it is designed to provide a furnace chamber 28, defined in the upper direction by the cover 26. By means of a vertical partition wall 30', this chamber 28 is divided into two compartments 29 and 30 arranged adjacent to each other. The only way in which a melt in the compartment 29 can communicate with the compartment 30 is by flowing over an overflow edge 32 of the partition 30'.

With the melting operation substantially as described before the melting proceeds so that eventually the surface level 34 in the compartment 29 is flush with the level 35 in the chamber 25. When the charging continues molten metal flows over the overflow edge 32 and is collected in the compartment 30, its surface level 33 then rising. In this way the furnace design provides for a replacement of the conventional metal heat retaining furnace, the furnace compartment 30 functioning both as a replacement for the furnace vessel 1 of FIGS. 1 and 2 while functioning as a special heat retaining furnace such as is normally seperate from the melting furnace. The compartment 30 can accommodate at least twice as much and preferably three times as much melt as the compartment 29. The vertical distance between the overflow edge 32 and the furnace vessel cover 26 is preferably smaller than 40% of the average height of the compartment 28. The compartment 30 containing the melt is provided with a controllable tapping hole 36 at its bottom. The compartment 30 can accommodate at least twice as much, preferably three times as much molten metal as the compartment 29 and which is functioning like the furnace vessel 1 of FIG. 2. This compartment 29 communicates via the inductor's longitudinal or horizontal holes 8 and 9 with an opening 31 in the furnace vessel 25 and of course with the opening 10' in the furnace vessel 1'.

In general the height of the petition 30 and therefore the level of its overflow edge 32 should be such that the compartment chamber 29 has an adequate volume so that when containing a melt it cooperates with the furnace vessel 1', in the manner previously described.

This special vessel is also provided with a roof 26 to the bottom of which the heat retaining electric resistance heating means is connected as shown at 21, for use during heat-retaining when the inductor is not operating.

The motor 37 of an air-cooling fan as shown in FIG. 5 for the purpose of cooling the inductor 6 should this be required.

Because the inductor block is externally parallelepepdic it adapts itself to combinations with other corresponding inductors having such inductor blocks.

Figure 6:
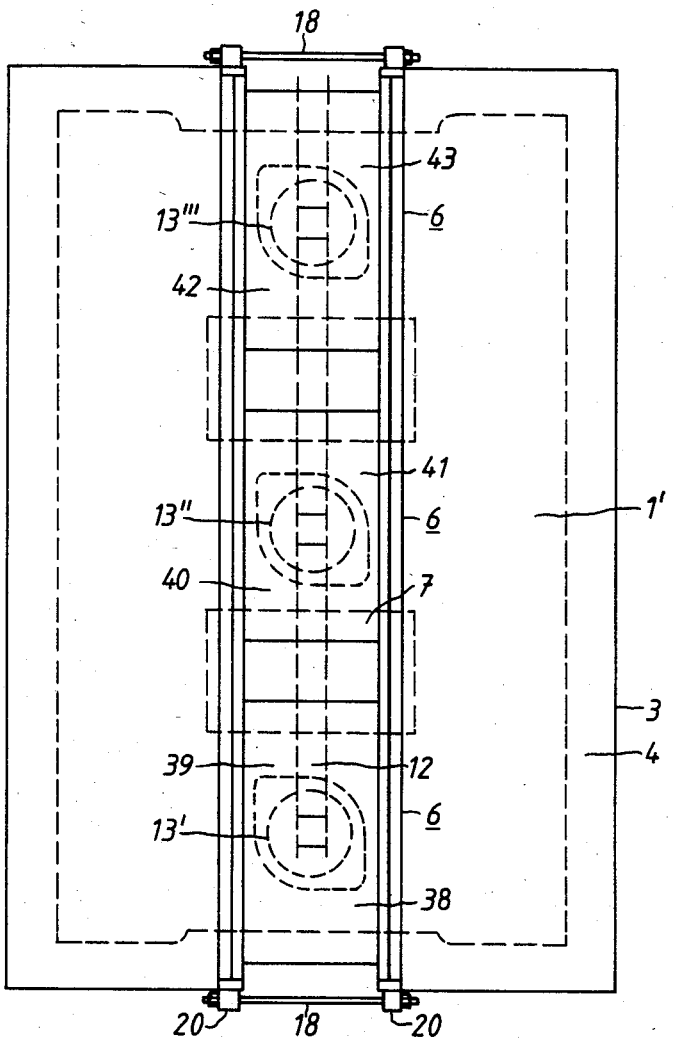
FIG. 6 is a top plan view showing how three inductors can be used to accommodate a 3-phase current supply, for example.
Figure 9:
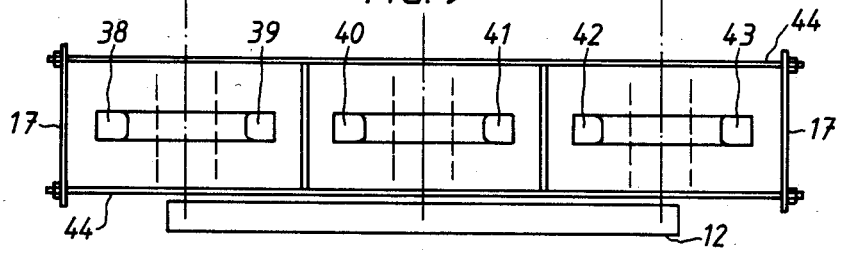
FIG. 9 is a side elevation of FIG. 8 with the core and coil assembly removed, and FIG. 10 schematically shows by top views how one or a number of the inductors can be optionally interconnected into assemblies of differing powers for use between the two furnace vessels.
Figure 8:
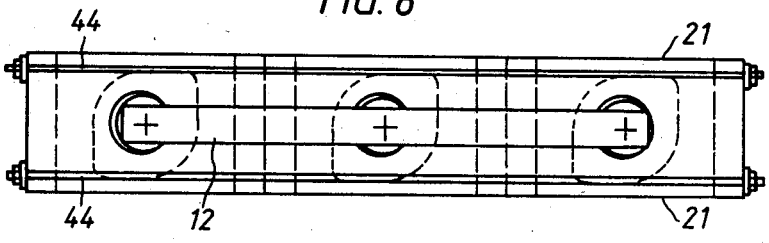
FIG. 8 is a top plan view and shows how three of the separable inductors be integrated as a unit for easy handling.

For example, FIG. 6 shows how three of the inductors 6 with their straight channels 38 and 39, 40 and 41, and 42 and 43 respectively then respective coils being shown at 13', 13'', and 13'', can be held together as an integrated unit in side-by-side arrangement, using transverse tension rods or, tie-bolts 44 as shown in FIGS. 8 and 9 which also illustrate this modification. A layer of ceramic felt (not shown) can be positioned between the inductor block. The straight inductor horizontal holes are shown at 38 to 43 in FIGS. 6 and 9. With the three inductors integrated they can be positioned between furnace chambers comprable to those shown at 1 and 1' in FIGS. 1 and 2, with appropriate vertical side wall openings.

Figure 7:
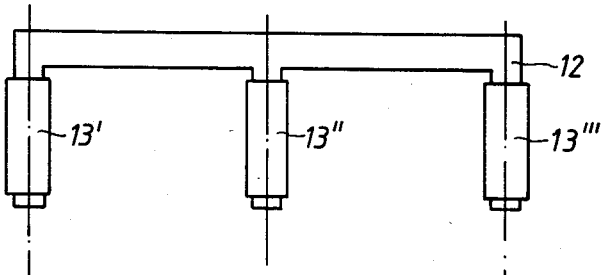
FIG. 7 in elevation shows a core and coil assembly for the FIG. 6 arrangement.

FIG. 7 serves to show how using this multiplicity of inductors the cores and windings can be made as a unit insertable into all three of the vertical or transverse holes of the inductor blocks, the yoke 12 shown at the bottom of FIG. 9 being then integrated with this core assembly.

Figure 10:
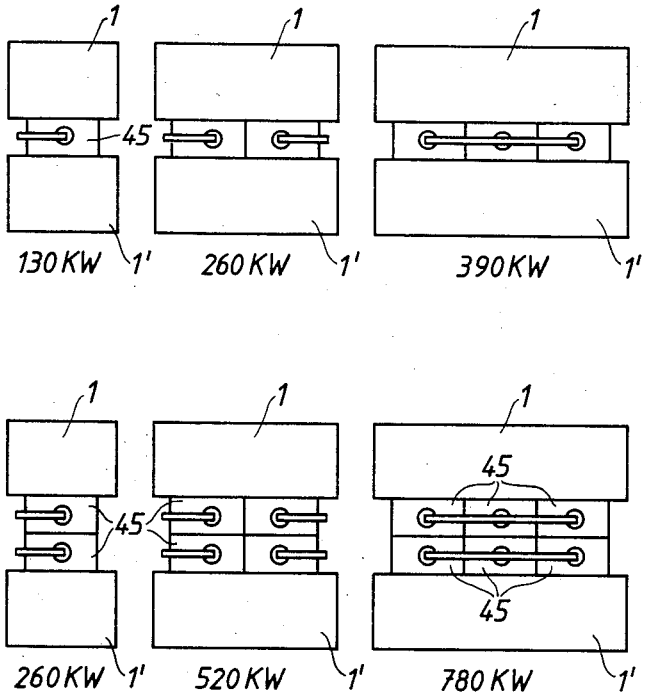

FIG. 10 shows how using this integrating or module concept the new inductors of the present invention can be used singely or in multiples to provide for differing power inputs ranging from 130 kw to 750 kw. In all cases the inductors are individually the same, thus reducing manufacturing costs and replacement costs. This versatility follows from the unique shape of the inductors.

In the case of the first example the furnace and all its parts is symmetrical. The furnace operation therefore is uniform as to both furnace vessels. This plane cuts through the center of the inductor.

In all examples the side wall openings for the inductor's horizontal through holes are near or at the bottoms of the furnace vessel chambers.

What is claimed is:

1. A metal melting furnace comprising two horizontally interspaced furnace vessels each forming a melt-containing chamber and each having a side wall facing the side wall of the other furnace and an opening in its side wall opening from its chamber and horizontally aligned with the opening of the side wall of the other furnace, and an inductor positioned between said side walls and comprising a single integral block of ceramic forming opposite ends abutting the outside of the side walls and a transverse through-hole and two horizontal through-holes straddling the transverse through-hole and having ends open to said chambers so the latter intercommunicate, and an inductor core provided with an energizing coil having a leg extending through said transverse through-hole, the opposite ends of the inductor's said block separably abutting the outsides of said side walls, one of said furnace vessels being horizontally movable towards and from the other furnace vessel so that the inductor is removable, and the furnace vessels having means releasably forcing and holding the furnace vessels together with the inductor between the side walls, at least one of said furnace vessels having a cover provided on its bottom with a heating means retaining the heat of a melt in that furnace vessel for a period of time when said inductor is unpowered.

2. A metal melting furnace comprising two horizontally interspaced furnace vessels each foming a melt-containing chamber and each having a side wall facing the side wall of the other furnace and an opening in its side wall opening from its chamber and horizontally aligned with the openings of the side wall of the other furnace, and an inductor positioned between said side walls and comprising a single integral block of ceramic forming opposite ends abutting the outside of the side walls and a transverse through-hole and two horizontal through-holes straddling the transverse through-hole and having ends open to said chambers so the latter intercommunicate, and an inductor core provided with an energizing coil having a leg extending through said transverse through-hole, the opposite ends of the inductor's said block separably abutting the outsides of said side walls, one of said furnace vessels being horizontally movable towards and from the other furnace vessel so that the inductor is removable, and the furnace vessels having means releasably forcing and holding the furnace vessels together with the inductor between the side walls, one of said furnace vessels being substantially larger than the other furnace vessel and forming a larger melt-containing chamber divided into two compartments by a vertical wall extending horizontally across the chamber and forming on one side a small compartment to which the opening in the wall of said one of the furnaces opens, the wall extending vertically to an overflow ledge at a level near the top of the furnace vessel over which a melt from the other furnace vessel can flow during progressive melting in the other furnace, said wall forming on its other side a large compartment receiving the melt from the small compartment, at least the large compartment having heat means retaining the heat from a melt therein.

* * * * *